United States Patent [19]

Crane et al.

[11] 4,202,688

[45] May 13, 1980

[54] HIGH CONDUCTIVITY HIGH TEMPERATURE COPPER ALLOY

[75] Inventors: Jacob Crane, Woodbridge; Eugene Shapiro, Hamden, both of Conn.; Stanley Shapiro, DeWitt, N.Y.; Brian Mravic, North Haven, Conn.

[73] Assignee: Olin Corporation, New Haven, Conn.

[21] Appl. No.: 34,403

[22] Filed: Apr. 30, 1979

Related U.S. Application Data

[63] Continuation-in-part of Ser. No. 947,963, Oct. 2, 1978, abandoned, which is a continuation of Ser. No. 547,367, Feb. 5, 1975, abandoned.

[51] Int. Cl.² ..... C22C 9/00; C22F 1/08

[52] U.S. Cl. ..... 75/153; 148/11.5 C; 148/12.7 C

[58] Field of Search ..... 75/153; 148/11.5 C, 148/12.7 C, 32.5, 160

[56] References Cited

U.S. PATENT DOCUMENTS

| | | | |
|---|---|---|---|
| 2,357,190 | 8/1944 | Evans | 75/159 |
| 2,802,733 | 8/1957 | Bungardt | 75/156.5 |
| 2,879,159 | 3/1959 | Bolkom et al. | 75/153 |
| 3,253,910 | 5/1966 | Burghoff et al. | 75/157.5 |
| 3,272,603 | 9/1966 | Larsen | 75/153 |
| 3,525,605 | 8/1970 | Pynna | 75/153 |
| 3,677,745 | 8/1957 | Finlay | 75/153 |
| 3,976,477 | 8/1976 | Crane et al. | 75/153 |

FOREIGN PATENT DOCUMENTS

| | | | |
|---|---|---|---|
| 192124 | 9/1957 | Austria | 75/153 |
| 41-20922 | 12/1966 | Japan | 75/153 |
| 45-21182 | 7/1970 | Japan | 75/153 |
| 206095 | 2/1967 | U.S.S.R. | 75/153 |

*Primary Examiner*—L. Dewayne Rutledge
*Assistant Examiner*—Peter K. Skiff
*Attorney, Agent, or Firm*—Paul Weinstein; Victor A. DiPalma

[57] ABSTRACT

A high conductivity high temperature copper alloy containing mischmetal, phosphorus and magnesium with specific ratios among them. The alloy is free from internal copper oxides and may be annealed at elevated temperatures in hydrogen atmospheres without embrittlement. Strengths on the order of 80 KSI and conductivities on the order of 90% IACS are obtainable in cold worked material.

11 Claims, No Drawings

HIGH CONDUCTIVITY HIGH TEMPERATURE COPPER ALLOY

CROSS REFERENCE TO RELATED APPLICATIONS

This case is a continuation-in-part of U.S. patent application Ser. No. 947,963, by Jacob Crane, Eugene Shapiro, Stanley Shapiro and Brian Mravic for HIGH CONDUCTIVITY HIGH TEMPERATURE COPPER ALLOY, filed Oct. 2, 1978, now abandoned, which in turn is a continuation of U.S. patent application Ser. No. 547,367, by Jacob Crane, Eugene Shapiro, Stanley Shapiro and Brian Mravic for HIGH CONDUCTIVITY HIGH TEMPERATURE COPPER ALLOY, filed Feb. 5, 1975, now abandoned.

BACKGROUND OF THE INVENTION

The present invention relates to high conductivity high temperature copper alloys, and particularly to such alloys which are free from internal copper oxides.

Oxygen free copper must be used in applications where the alloy is to be annealed in a hydrogen containing atmosphere, as the presence of oxygen in either its elemental state or as copper oxide results in the formation of water vapor during the annealing process which causes embrittlement of the alloy.

Two major methods are used to reduce the oxygen level of copper so as to avoid embrittlement. The first method involves casting the alloy in an inert atmosphere and fluxing the molten copper with an inert gas to reduce the oxygen level. This is a complex process and difficult to perform satisfactorily. The other major method of deoxidizing copper consists of adding a reactive material to the melt which will form an oxide in preference to copper oxide. The reactive material is chosen so that its oxide will be stable and will not be reduced by hydrogen during annealing. Unfortunately, most of the reactive materials used have a highly deleterious effect on electrical conductivity if excess reactive material remains in solution in the deoxidized copper alloy. Because of the reactive nature of the materials used, it is difficult to accurately control the amount of reactive material which is actually needed to deoxidize the molten copper without causing a loss of conductivity.

In addition to the above, it is known that oxygen free copper has relatively low mechanical properties and it is highly desirable to improve these properties while simultaneously maintaining a high electrical conductivity. Further, oxygen free copper has a very low softening point and for many applications it would be highly desirable to maximize strength and conductivity and to increase the softening temperature. Finally, care must be taken in the processing of oxygen free copper to avoid the reintroduction of oxygen into the alloy. For example, when welding oxygen free copper, an inert atmosphere must be used so as to protect the molten material in the weld zone from oxidation.

Mischmetal has been used as a deoxidizing material in the production of oxygen free copper, however, when excess mischmetal is present, a low melting point eutectic forms between Cu and $CeCu_6$ compound which results in an alloy which is unsuitable for high temperature brazing and other similar applications where high temperatures are encountered.

SUMMARY OF THE INVENTION

In accordance with the present invention, copper base alloys possessing high conductivity and temperature stability together with freedom from internal copper oxides are prepared which contain mischmetal or lanthanides in place thereof, phosphorus and magnesium with the balance essentially copper. The mischmetal content of the alloys of the present invention ranges from 0.012 to about 0.5%, the phosphorus content may range from about 0.011 to about 0.5% and magnesium content ranges from about 0.007 to about 0.4%. The phosphorus, mischmetal and magnesium contents of the present invention are interrelated, and a specific ratio of phosphorus to mischmetal and magnesium must be maintained for improved results.

The three alloying additions serve as deoxidizing elements and a strengthened condition results in the alloys which is believed to be related to the formation of magnesium containing precipitates. This strengthening mechanism allows the development of a desirable combination of conductivity and strength properties.

The alloys of the present invention are characterized by being oxidation resistant in high temperature contact with air. Since their preparation in accordance with the present invention employs chemical deoxidizing techniques, the alloys are resistant to internal copper oxide formation and subsequent hydrogen embrittlement during hot processing or other elevated temperature exposure. This is a significant advantage over high purity copper produced by a mechanical type of degassing operation which is susceptible to surface oxidation and internal oxide formation during thermal applications such as welding conducted in oxygen containing atmosphere.

The alloys of the present invention likewise exhibit improved properties in comparison with conventionally produced oxygen free copper and copper which has been deoxidized with mischmetal alone. Increases on the order of 50° C. are observed in softening temperatures and improvements are noted in tensile properties.

Accordingly, it is a principal object of the present invention to provide a copper base alloy in the deoxidized condition which possesses high conductivity, improved strength and thermal stability.

It is a further object of the present invention to provide a copper base alloy as aforesaid which is easily and inexpensively fabricated.

It is a yet further object of the present invention to provide an alloy as aforesaid which is resistant to surface and internal oxidation during high temperature contact with oxygen containing atmosphere.

Further objects and advantages will be apparent after a consideration of the invention proceeds with reference to the description which follows.

DESCRIPTION OF THE PREFERRED EMBODIMENTS

In accordance with the present invention the foregoing objects and advantages are readily obtained.

The alloys of the present invention are copper base alloys containing in excess of 99% copper and intentional alloying additions of mischmetal, phosphorus and magnesium. The term mischmetal describes a material composed largely of lanthanides comprising Elements Nos. 58–71 on the Periodic Table. A typical mischmetal composition is listed below:

| | |
|---|---|
| Cerium | 50% |
| Lanthanum | 27% |
| Neodymium | 16% |
| Praseodymium | 5% |
| Other Rare Earth Metals | 2% |

However, as used in this application the term mischmetal is intended to include any material comprised predominately of lanthanide regardless of the relative proportions thereof. For example, cerium alone could be used in place of mischmetal and would provide equally satisfactory results.

The mischmetal content of the alloys of the present invention will range from 0.012 to 0.5% and will preferably range from 0.018 to 0.4%. Phosphorus will be present from 0.011 to 0.5% and will preferably be present in levels from 0.017 to 0.4%. Magnesium is present from 0.007 to 0.4% and preferably from 0.01 to 0.32%.

It has surprisingly been found that the alloying additions of the present invention react to form intermetallic compounds within the alloy thereby conferring desirable mechanical properties upon the alloy. Specifically, the mischmetal and phosphorus are believed to combine to form a series of compounds analogous to the compound CeP at the stoichiometric ratio of 4.52 phosphorus:1 mischmetal:phosphorus upon solidification of the alloy or shortly thereafter. During subsequent thermal treatments, it is believed that the magnesium reacts with phosphorus to form a compound which is believed to be $Mg_3P_2$. The stoichiometric relationship of this compound is 1.17 phosphorus to 1.0 magnesium. To maximize the formation of this compound, it is desirable to provide excess phosphorus over that which would be required to react completely with the mischmetal. Therefore, the preferred relationship between the alloy additions is given by the equation: phosphorus equals mischmetal divided by 4.52 plus magnesium divided by 1.17. Magnesium should be added slightly in excess of that required to completely form $Mg_3P_2$ and, preferably, in quantities of less than 0.1% in excess of the phosphorus which remains in solid solution after the mischmetal phosphorus reaction. Preferably, a slight excess of magnesium should be present over that required to completely form $Mg_3P_2$, since magnesium in solid solution has less deleterious effect upon conductivity than does phosphorus in solid solution.

In addition to an excess of magnesium, it is contemplated that an excess of phosphorus may be present in amounts ranging up to about 0.025% without deleteriously affecting the properties of the alloy. Specifically, excess phosphorus will tend to increase strength while maintaining conductivity at an acceptable level.

During the course of the formation of the aforenoted compounds of mischmetal, phosphorus and magnesium, small amounts of compounds containing mixtures of mischmetal and/or phosphorus and/or magnesium may be formed which contain other incidental elements. While these compounds may affect conductivity somewhat, they will not affect the strength of the resulting alloy.

Metallographic and X-ray spectrographic analysis of an alloy processed in accordance with this invention containing nominally 0.12% mischmetal, 0.05% magnesium, 0.05% phosphorus and the balance copper revealed particles possessing a large, coarse string-like structure. These particles are believed to form at a relatively high temperature such as the temperature level adjacent but after solidification of the alloy. X-ray spectrographic analysis revealed that the particles included magnesium, phosphorus and mischmetal in the form of cerium and lanthanum. It is, therefore, believed that the particles comprise a combination or compound involving components of mischmetal, magnesium and phosphorus. It is believed that the precipitate particles form at a point in time during the processing of the alloy prior to the time the alloy is cold worked and aged. It is believed that the formation of a precipitate particle including three elements comprising mischmetal or a lanthanide, along with magnesium and phosphorus in accordance with the present invention provides a structural novelty which is in contrast to the teachings of the prior art.

The preceding discussion has assumed that the compounds formed are based on cerium, however, it will be appreciated that because of the great chemical similarity between the lanthanides, analogous compounds will be formed based on the other lanthanides and these analogous compounds will have very similar characteristics.

The magnesium-phosphorus reaction appears to occur between temperatures of 200° C. and 500° C. and reaction times vary from 15 minutes to 10 hours depending upon temperature and composition. Extremely desirable properties are obtained by subjecting the alloy to repeated cycles of cold working and annealing at temperatures ranging from 200° to 400° C. The intermediate cold working is believed to provide a defect structure which enhances the $Mg_3P_2$ reaction.

The alloys of the present invention possess a further significant advantage over conventionally prepared oxygen free copper in that they retain their resistance to oxide formation even when exposed to high temperatures in air, as, for example, in welding applications since the mischmetal, phosphorus and magnesium which remain in the alloy will oxidize in preference to the copper constituent. Accordingly, even after the alloys have been welded in air, they may be annealed in hydrogen without embrittlement.

Because of the reactive nature of the additives of the present invention, it is highly desirable to add the mischmetal in a continuous form immediately before the molten metal enters the mold. This form of addition is particularly practical in a continuous casting operation. Reference is made to U.S. Pat. No. 3,728,827 which deals with this subject and which is assigned to the assignee of the present invention. Because of its reactivity, magnesium may be added in a similar fashion, however, this is not absolutely necessary. Likewise, the phosphorus may be added in bulk form to the molten metal, or in the continuous fashion discussed above. Subsequently, casting of the alloys of the present invention may be performed using conventional techniques and, in general, the methods used may be similar to those used for other high copper alloys.

The alloys of the present invention may be processed to final form using conventional processing techniques. If it is desired to obtain maximum strength with moderate conductivity, the following procedure may be followed; the alloy should be hot rolled at a temperature of more than 500° C. to a desired intermediate gauge. The alloy should then be cold worked at a temperature of less than 200° C. to obtain a reduction in excess of 10%. The alloy may then be heat treated at a temperature from 250° to 400° C. for a time of between 15 minutes and 24 hours. A particularly desirable combination of properties may be obtained by successively repeating the cold working and heat treating steps a plurality of times.

The present invention will be more readily understandable from a consideration of the following illustrative examples.

EXAMPLE I

Alloys of varying compositions were produced by melting copper and making additions of the desired elements which were wrapped in copper foil and submerged in the molten copper. The composition of these alloys is listed in Table I, below.

TABLE I

ANALYZED ALLOY COMPOSITIONS, WEIGHT PERCENT

| Alloy Identification | Cu | P | Mg | MM* | Excess** |
|---|---|---|---|---|---|
| V401 | bal. | 0.070 | 0.057 | 0.12 | .007 Mg |
| V402 | bal. | 0.050 | 0.054 | 0.12 | .027 Mg |
| V403 | bal. | 0.037 | 0.023 | 0.11 | .006 Mg |
| V404 | bal. | 0.042 | 0.037 | 0.13 | .033 Mg |
| 1699 | bal. | 0.068 | 0.031 | 0.15 | .009 P |

*MM is mischmetal

**Based on all the mischmetal first reacting to form CeP then the remaining phosphorus reacting with magnesium to form $Mg_3P_2$.

Referring to the table, the values listed in the column labeled "Excess" were calculated on the basis of mischmetal first reacting with phosphorus to form CeP with the remaining magnesium to form $Mg_3P_2$. The quantity given in the column is the excess material remaining after the completion of these reactions. After solidification these alloys were hot rolled at a temperature of 800° C. from a thickness of 1.75" to 0.6". No difficulties were encountered in this hot rolling operation.

EXAMPLE II

The hot rolled alloys of Example I were given a variety of thermal mechanical treatments to investigate aging behavior. The aging behavior was evaluated through measurement of electrical conductivity. In general, electrical conductivity decreases when precipitation occurs, since the formation of precipitate particles remove solute material from solid solution. The thermal mechanical treatments included various combinations of cold rolling and annealing steps as set forth in Table II, below.

TABLE II

CONDUCTIVITY % IACS OF Cu-MM-P-Mg ALLOYS

| Processing | Alloy Identification V401 | V402 | V403 | V404 | 1699 |
|---|---|---|---|---|---|
| As hot rolled (HR) | | | | | 68 |
| HR + CR* 45% | 66 | 74 | 81 | 84 | |
| HR + 500° C./2 hrs. | | | | | 93 |
| HR + CR 45% + 500° C./2 hrs | 93 | 95 | 90 | 93 | |
| HR + CR 45% + 350° C./1 hr | 79 | 82 | 85 | 86 | |
| HR + CR 45% + 350° C./8 hrs | 94 | 95 | 93 | 95 | |

*Cold Rolled

Referring to the table, it should be noted that the effect of these treatments is also set forth therein, and precipitation thus appears to occur when the alloys are heat treated at temperatures between 350° and 500° C. It is also evident that any of the alloys in Example I can be heat treated to achieve an electrical conductivity of at least 93%.

EXAMPLE III

The alloys of Example I were given a variety of thermal mechanical heat treatments in an effort to determine what processing would provide optimum conductivity and what processing would provide optimum mechanical properties. Starting at hot rolled gauge of approximately 0.006" the processing sequences were as follows:

(A) cold roll to 0.200", anneal at 350° C. for 4 hours, cold roll to 0.100", anneal at 350° C. for 4 hours, cold roll to 0.020" and to 0.008" to provide total reductions of 90% and 96%, respectively;

(B) cold roll to 0.200", anneal at 350° C. for 8 hours, and cold roll to 0.020" and 0.008" to provide total reductions of 90% and 96%, respectively;

(C) cold roll to 0.200", anneal at 500° C. for 2 hours, cold roll to 0.020" and 0.008" to provide total reductions of 90% and 96%, respectively;

(D) cold roll to 0.036" and 0.010" to provide total reductions of 90% and 97%, respectively.

Table III, presented below, shows the effect of these processing sequences on the alloys of Example I in terms of ultimate tensile strength and electrical conductivity.

TABLE III

ULTIMATE TENSILE STRENGTH, KSI, AND CONDUCTIVITY OF Cu-MM-P-Mg ALLOYS GIVEN DIFFERENT PROCESSING

Process Sequence A: HR + CR* 0.200" + 350° C./4hr + CR 0.100" + 350° C./4hr + CR 0.020" (90% CR) and 0.008" (96% CR)

Process Sequence B: HR + CR 0.200" + 350° C./8hr + CR 0.020" (90% CR) and 0.008" (96% CR)

Process Sequence C: HR + CR 0.200" + 500° C./2hr + CR 0.020" (90% CR) and 0.008" (96% CR)

Process Sequence D: HR + CR 0.036" (90% CR) and 0.010" (97% CR)

| | | PROCESSING SCHEDULE | | | | | | | |
|---|---|---|---|---|---|---|---|---|---|
| | | A | | B | | C | | D | |
| Alloy | % CR* | UTS** | % IACS | UTS | % IACS | UTS | % IACS | UTS | % IACS |
| V401 | 90 | 80 | 88 | 88 | 78 | 74 | 88 | — | — |
| V401 | 96 | 84 | 89 | 90 | 78 | 78 | 88 | — | — |
| V402 | 90 | 79 | 88 | 84 | 83 | 75 | 89.5 | — | — |
| V402 | 96 | 83.5 | 86 | 89 | 80.5 | 77 | 92 | — | — |
| V403 | 90 | 73 | 87 | 78 | 82 | 71 | 88 | — | — |
| V403 | 96 | 77.5 | 87 | 80 | 82 | 76.5 | 88 | — | — |
| V404 | 90 | 74 | 89 | 79 | 86 | 71 | 89.5 | — | — |
| V404 | 96 | 79.5 | 86 | 79.5 | 86 | 75 | 89 | — | — |
| 1699 | 90 | 73.5 | 80.5 | | | | | 73.5 | 69 |

TABLE III-continued

ULTIMATE TENSILE STRENGTH, KSI, AND CONDUCTIVITY OF Cu-MM-P-Mg ALLOYS GIVEN DIFFERENT PROCESSING

Process Sequence A: HR + CR* 0.200" + 350° C./4hr + CR 0.100" + 350° C./4hr + CR 0.020" (90% CR) and 0.008" (96% CR)

Process Sequence B: HR + CR 0.200" + 350° C./8hr + CR 0.020" (90% CR) and 0.008" (96% CR)

Process Sequence C: HR + CR 0.200" + 500° C./2hr + CR 0.020" (90% CR) and 0.008" (96% CR)

Process Sequence D: HR + CR 0.036" (90% CR) and 0.010" (97% CR)

| | | PROCESSING SCHEDULE | | | | | | | |
|---|---|---|---|---|---|---|---|---|---|
| | | A | | B | | C | | D | |
| Alloy | % CR* | UTS** | % IACS | UTS | % IACS | UTS | % IACS | UTS | % IACS |
| 1699 | 97 | 75 | 80.5 | | | | | 78.5 | 69 |

*Cold Rolling

**Ultimate Tensile Strength

From the data presented above, it can be seen that the alloys of the present invention are susceptible to a wide variety of processing schemes and that different processing techniques will yield different combinations of properties. Processing sequence A provides the best combination of strength and conductivity, while processing sequence B improves strength at the expense of electrical conductivity. Processing sequence C emphasizes electrical conductivity at the expense of tensile strength and processing sequence D demonstrates that some intermediate thermal treatments are necessary if beneficial properties are to be obtained in the present alloys.

EXAMPLE IV

An effort was made to improve upon the results obtained through applying processing sequence A of Example III to the present alloys. This process was designated as processing sequence E and consisted of cold rolling hot rolled plate to 0.200", annealing at 350° C. for 4 hours, cold rolling to 0.100" and annealing at 350° C. for 4 hours, cold rolling to 0.020", and annealing at 250° C. for 1 hour. The material was then cold rolled to 0.008" for a total reduction of 96%. A comparison of the results of this process with the results of process A is given in Table IV, below.

TABLE IV

ULTIMATE TENSILE STRENGTH, KSI, AND CONDUCTIVITY, % IACS, FOR Cu-MM-P-MG ALLOYS GIVEN LOW TEMPERATURE AGING

Process Sequence A: HR + CR 0.200" + 350° C./4hr + CR 0.100" + 350° C./4hr + CR 0.008 (96% CR*)

Process Sequence E: HR + CR 0.200" + 350° C./4hr + CR 0.100" + 350° C./4hr + CR 0.020" + 250° C./1hr + CR 0.008" (96% CR)

| | Process A | | Process B | |
|---|---|---|---|---|
| Alloy | UTS** | % IACS | UTS | % IACS |
| V401 | 84 | 89 | 83.5 | 90 |
| V402 | 83.5 | 86 | 82.5 | 89 |
| V403 | 77.5 | 87 | 78.5 | 89 |
| V404 | 79.5 | 86 | 79 | 89.5 |

*Cold Rolling

**Ultimate Tensile Strength

From the data presented above, it can be seen that the additional low temperature heat treatment present in process E improves the electrical conductivity by 1 to 3%, while having little effect on the ultimate tensile strength. For properties where electrical conductivity is important, process E is preferred.

EXAMPLE V

A variety of competitive commercial alloys were evaluated and compared to the alloys of the present invention. All materials received a total reduction of 90%, the alloy of the present invention was treated according to process A set forth in Example III. The results of this comparison are given in Table V, below.

TABLE V

COMPARISON OF 90% COLD ROLLED STRENGTH AND CONDUCTIVITY OF Cu-MM-P-Mg ALLOYS WITH THOSE OF COMPETITIVE COMMERCIAL COPPER ALLOYS

| Alloy | Ultimate Tensile Strength, ksi | Conductivity % IACS |
|---|---|---|
| CDA 102 OFHC | 66 | 99 |
| CDA 129 Silver Bearing Cu | 65 | 96 |
| Cu-Zr | 60 | 93 |
| CDA 194 Cu-Fe-P | 78 | 60 |
| V401 Cu-MM-Mg-P | 80 | 88 |

It is evident from this table that the alloy of the present invention possesses significantly higher strengths than any of the competitive alloys having comparable electrical conductivities.

EXAMPLE VI

Additional alloy samples of this invention were prepared and processed in a variant manner. The alloys were cast as in Example I, and the cast structures were solutionized at a temperature of 900° C. After solutionizing, the alloys were cold worked 75% and then aged at temperatures of from 400° to 500° C. Solutionizing and aging were conducted for 2 hours. After aging, the alloys were cold worked 75%. After the final cold working was completed, tensile, elongation and conductivity measurements were taken. The results of these tests together with the composition of the respective samples are set forth in Table VI, below.

TABLE VI

CONDUCTIVITY - STRENGTH - ELONGATION OF Cu-MM*-P-Mg ALLOYS

| | Composition (Weight %) | | | | Conductivity (% | Yield Strength 0.2% Offset | Elong. 2 in. |
|---|---|---|---|---|---|---|---|
| Alloy | Cu | MM* | P | Mg | IACS) | (ksi) | % |
| 61 | Bal. | 0.24 | 0.06 | 0.04 | 88 | 67 | 3 |
| 81 | Bal. | 0.1 | 0.20 | 0.24 | 76 | 82 | 3 |

TABLE VI-continued

CONDUCTIVITY - STRENGTH - ELONGATION OF Cu-MM*-P-Mg ALLOYS

| Alloy | Composition (Weight %) Cu | MM* | P | Mg | Conductivity (% IACS) | Yield Strength 0.2% Offset (ksi) | Elong. 2 in. % |
|---|---|---|---|---|---|---|---|
| 81** | Bal. | 0.1 | 0.20 | 0.24 | 89 | 71 | 3 |

*MM - Mischemetal

**Aging treatment conducted at 500° C.; other samples aged at 400° C.

From the above data, it can be seen that the alloys of this invention are capable of a wide variety of formulations and processing to prepare materials possessing properties suitable for diverse applications.

The alloys of the present invention are suitable for high temperature applications such as welding or brazing, as well as electrical applications such as receptacles, connectors and the like.

Throughout the specification, all percentages are expressed as percentage by weight.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A silver free copper base alloy possessing high strength and high conductivity consisting essentially of from about 0.012 to about 0.5% of an element selected from the group consisting of the lanthanide series of the Periodic Table and mixtures thereof, from about 0.011 to about 0.5% of phosphorus, from about 0.007 to about 0.4% magnesium, balance essentially copper, wherein said alloy contains precipitate particles of the lanthanide and phosphorus, $Mg_3P_2$, and a precipitate consisting essentially of the lanthanide, magnesium and phosphorus wherein said quantities of said lanthanide, said magnesium and said phosphorus may be other than the stoichiometric ratios thereof defined by an equation wherein phosphorus content equals the content of said lanthanide divided by 4.52 plus the content of said magnesium divided by 1.17 while maintaining high strength and high conductivity.

2. The alloy of claim 1 wherein said element comprises mischmetal.

3. The alloy of claim 1 wherein said element comprises cerium.

4. The alloy of claim 1 wherein said element is present in an amount ranging from about 0.018 to about 0.4%, said phosphorus is present in an amount ranging from about 0.017 to about 0.4% and said magnesium is present in an amount ranging from about 0.01 to about 0.32%.

5. The alloy of claim 1 wherein said precipitate consisting essentially of the lanthanide, magnesium and phosphorus possesses a coarse string-like structure.

6. A method for the preparation of a high strength high conductivity silver free copper base alloy which comprises:

(A) providing a copper base alloy consisting essentially of 0.018–0.5% of an element selected from the group consisting of the lanthanide series of the Periodic Table and mixtures thereof, from 0.011–0.5% phosphorus, from 0.007–0.4% magnesium, balance essentially copper, wherein said alloy contains precipitate particles of the lanthanide and phosphorus, $Mg_3P_2$, and a precipitate consisting essentially of the lanthanide, magnesium and phosphorus;

(B) hot working said alloy at a temperature in excess of 500° C.;

(C) cold working said alloy at a temperature of less than 200° C.; and (D) aging said cold worked alloy at a temperature of from 250°–400° C. for from 15 minutes to 24 hours.

7. The method of claim 5 wherein said alloy consists essentially of 0.018–0.4% of said element, 0.017–0.4% of said phosphorus and 0.01–0.32% of said magnesium.

8. The method of claim 5 wherein said element comprises mischmetal.

9. The method of claim 5 wherein said element comprises cerium.

10. The method of claim 5 wherein steps C and D are repeated a plurality of times.

11. The method of claim 5 wherein said precipitate consisting essentially of the lanthanide, magnesium and phosphorus possesses a coarse string-like structure.

* * * * *

UNITED STATES PATENT AND TRADEMARK OFFICE

CERTIFICATE OF CORRECTION

PATENT NO. : 4,202,688

DATED : May 13, 1980

INVENTOR(S) : Jacob Crane, Eugene Shapiro, Stanley Shapiro and Brian Mravic

It is certified that error appears in the above—identified patent and that said Letters Patent is hereby corrected as shown below:

In Column 10, line 35, change "5" to ---6---;

In Column 10, line 38, change "5" to ---6---;

In Column 10, line 40, change "5" to ---6---;

In Column 10, line 42, change "5" to ---6---; and

In Column 10, line 44, change "5" to ---6---.

Signed and Sealed this

*Fourteenth* Day of *September 1982*

[SEAL]

*Attest:*

GERALD J. MOSSINGHOFF

*Attesting Officer*

*Commissioner of Patents and Trademarks*